US011213738B1

(12) United States Patent
Groenenboom

(10) Patent No.: US 11,213,738 B1
(45) Date of Patent: Jan. 4, 2022

(54) VARIABLE TORSION SKATEBOARD TRUCK APPARATUS AND METHOD OF ADJUSTMENT

(71) Applicant: Mark Groenenboom, Wyoming, MI (US)

(72) Inventor: Mark Groenenboom, Wyoming, MI (US)

(73) Assignee: Mark Groenenboom, Wyoming, MI (US)

( * ) Notice: Subject to any disclaimer, the term of this patent is extended or adjusted under 35 U.S.C. 154(b) by 0 days.

(21) Appl. No.: 17/065,744

(22) Filed: Oct. 8, 2020

(51) Int. Cl.
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/012; A63C 17/015
See application file for complete search history.

(56) References Cited

U.S. PATENT DOCUMENTS

| | | | | |
|---|---|---|---|---|
| 4,152,001 | A * | 5/1979 | Christianson | A63C 17/01 280/11.28 |
| 4,155,565 | A * | 5/1979 | de Caussin | A63C 17/0046 280/11.19 |
| 4,515,379 | A | 5/1985 | Pasques | |
| 7,303,199 | B2 | 2/2007 | Chen | |
| 7,306,240 | B2 | 12/2007 | Chen | |
| 7,837,204 | B1 | 11/2010 | Groenenboom | |
| 8,454,038 | B2 | 4/2013 | O'Rourke | |
| 9,555,314 | B2 | 1/2017 | Groenenboom | |
| 2016/0339329 | A1* | 11/2016 | Groenenboom | A63C 17/012 |
| 2018/0185738 | A1* | 7/2018 | Strand | A63C 17/006 |
| 2019/0118069 | A1* | 4/2019 | Augustin | A63C 17/012 |
| 2019/0351314 | A1* | 11/2019 | Lewis | A63C 17/013 |

* cited by examiner

*Primary Examiner* — Brian L Swenson
(74) *Attorney, Agent, or Firm* — Robert Anton Pasic

(57) ABSTRACT

A skateboard truck that is adjusted for different amounts of torsional stiffness. The axle of the truck is tensioned to change the torsional stiffness of the truck. The truck includes a fork shaped structural arm having tongs on the distal end. The ends of the tongs include mounting for the axle which supports the wheels. The tension in the axle determines the amount of torsional stiffness. Additionally, the distance between the wheels is adjustable to affect the torsional stiffness.

21 Claims, 15 Drawing Sheets

VARIABLE TORSION SKATEBOARD TRUCK APPARATUS AND METHOD OF ADJUSTMENT

CROSS-REFERENCE TO RELATED APPLICATIONS

Components of the present technology have been disclosed in U.S. Pat. No. 9,555,314. Also, in a provisional patent application U.S. 62/949,479. Please understand that the applicant is making a priority claim to the provisional patent application U.S. 62/949,479.

STATEMENT REGARDING FEDERALLY SPONSORED RESEARCH OR DEVELOPMENT

Not applicable

NAMES OF PARTIES TO A JOINT RESEARCH AGREEMENT

Not applicable

BACKGROUND

The present technology is directed to a variable torsion skateboard truck apparatus. Skateboards have evolved into several different disciplines such as trick, to vert, to high speed downhill skating and as a form of exercise and transportation. The present apparatus may be used to permit a rider to adjust the performance and feel of a skateboard. Specifically, a property of a skateboard may include the torsional stiffness of the device. The torsional stiffness is explained in more detail below, but to summarize, the torsional stiffness affects the rate that a skateboard moves into the level position after it has been tilted to the side. The present technology allows the operator to adjust the side to side torsional stiffness of the skateboard.

SUMMARY

According to some embodiments, the present technology is directed to an adjustable torsional stiffness skateboard truck. The adjustment of the torsional stiffness is provided so that a user can change the feel and response of the skateboard truck and therefore the skateboard.

An adjustable torsion stiffness skateboard truck has been found to have many applications which are not currently addressed. Currently, skateboard trucks have a fixed torsional stiffness. The torsional stiffness can affect the skateboard response while performing tricks. In high speed applications the stiffness is critical for safety as harmonic vibrations can cause a user to lose control of the skateboard.

The present technology may be configurable in multiple ways. The axial tension is adjustable. By increasing and decreasing the axle tension the user can fine tune this response. Also, the device provides for changing the distance between the wheels. As can be appreciated this also changes the torsional stiffness of the skateboard truck. As an added advantage the present technology provides for raising and lowering the height of the skateboard truck, this can be helpful to some users depending on their type of skateboarding.

The present technology may be based on the technology included in U.S. Pat. No. 9,555,314 which is hereby included by reference. The U.S. Pat. No. 9,555,314 patent describes a rear skateboard truck that provides for tilting the skateboard without causing the truck to turn. This property helps the user propel the skateboard forward as disclosed in the above patent. The present technology may be incorporated with the technology in U.S. Pat. No. 9,555,314; however, this is not a necessary requirement expect as provided for in the included claims. Additionally, the applicant is including provisional application U.S. 62/949,479 and claiming priority to this provisional application filing date Dec. 18, 2019.

Broadly an adjustable torsional stiffness skateboard truck is disclosed. In some embodiments the truck may have a fork shaped structural arm having two tongs located distally from an attachment end for attachment to a skateboard. The tongs being compliant and having a compliant support bushing on the distal end of each tong. An axle located in the compliance bushings of the structural arm and having a first end and a second end. These compliance bushings may be spherical bushings or simply made of a compliant material such as a suitable polyurethane or plastic. Two wheels supported by the axle and being coaxial with the axle and located outside of each tong such that the axle first end and second end extend outside the two wheels. A stop spacer located coaxially with the axle and between each tong. This stop spacer being of a length that prevents the tongs being deflected past a predetermined amount. This has the advantage of allowing an operator to tension the shaft without damaging the tongs by plastically deforming them. In order to tension the axle a means of clamping the wheels against each tong is provided.

To provide for accurate tensioning of the axle a support bushing located coaxial with the stop spacer and between each tong is provided. The support bushing along with the fork shaped structural arm and tongs provide additional support when tensioning the axle. However, since this is a separate component, it can easily be removed from the truck and thus allow for reducing the axle tension.

The means of clamping the wheels against each tong for loading the axle in tension may include an enlarged portion on the axle first end and a threaded portion on the second end and a nut installed on the threaded portion of the axle. this configuration allows a user to simply tighten or loosen the nut to establish the correct axle tension.

The means of clamping the wheels against each tong for the loading the axle in tension may include a stop spacer that is an integral feature of the axle, the stop spacer including at least one flat such that the axle can be gripped for clamping the wheels. In this embodiment the axle may include a threaded portion on the axle first end and a threaded portion on the second end and a nut installed on each threaded portion of the axle. This allows the user to set the tension in each end of the axle to a different tension and this may be an advantage depending on the particular user or the terrain.

In some embodiments the height of the skateboard is determined by flipping the truck over. The fork shaped structural arm include an attachment end distal from the tong end. This attachment end has a first attachment side and a second attachment side defining a centerline between the first and second attachment sides. The compliant support bushing on the distal end of each tong is offset from the centerline, such that attachment to a surface (the bottom side of a skateboard, as an example) on the first attachment side results in a first distance of the compliant support bushing on the distal end of each tong to the surface while attachment on the second attachment side to the surface results in a second distance of the compliant support bushing on the distal end of each tong to the surface such that the first and second distances are not equal.

In another embodiment at least two clamp spacers are located coaxially with the axle and on the outside of each tong and inside each wheel. These clamp spacers can be added or removed as needed to adjust the distance between the wheels. This adjustment may cause a change in the torsional stiffness of the truck.

Additionally, method of using an adjustable torsional stiffness skateboard truck is disclosed. This method of adjustment may include installing or removing at least one clamp spacer causing the distance between the two wheels to decrease or increase after clamping the wheels against each tong for loading the axle in tension.

An additional, a method of using an adjustable torsional stiffness skateboard truck is disclosed. This method of adjustment may include clamping the wheels against each tong for loading the axle in tension.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Generally, the present disclosure pertains to devices and methods for a variable torsion skateboard truck.

A skateboard truck with adjustable torsional stiffness comprising a fork shaped structural arm having two tongs and having a hole on the distal end of each tong, the two tongs being able to flex relative to each other such that they have a predetermined spring rate, an axle located in the holes of the structural arm two wheels coaxial with the axle, and located against the outside of each tong, an axle sleeve located coaxially with the axle and between each tong, the axle sleeve being of a length that prevents the tongs are being deflected past a predetermined amount a means of clamping the wheels against each tong and loading the axle in tension.

Figure 1:
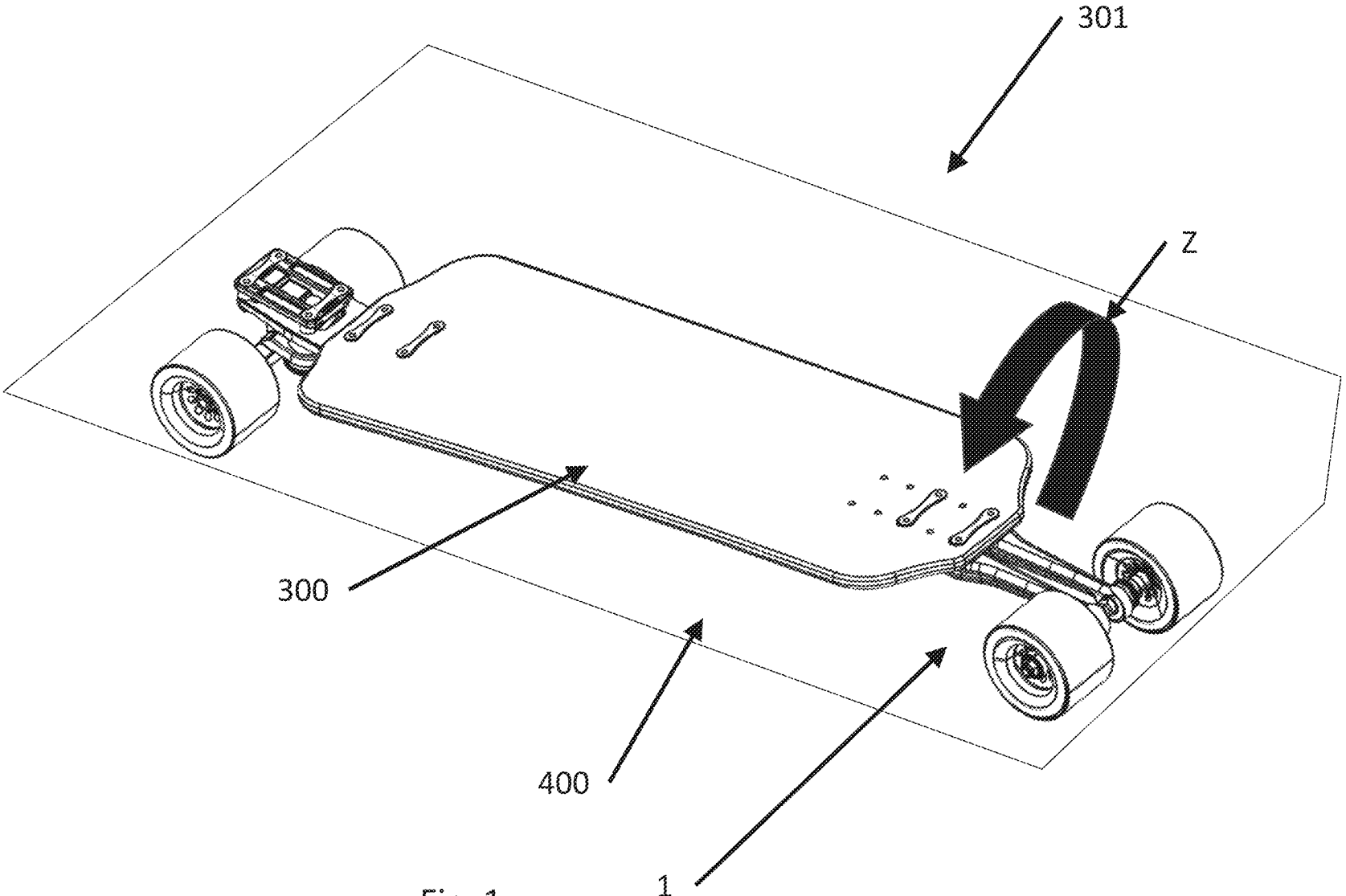
FIG. 1 depicts a view of a skateboard with a variable torsion skateboard truck and illustrates the torsional stiffness direct.

Referring to FIG. 1, an adjustable torsional stiffness skateboard truck 1 is shown. The torsional stiffness of the skateboard truck is the stiffness of the skateboard body 300 about the Z direction as shown in FIG. 1. As an operator twists the skateboard body 300, the truck 1 allows the skateboard 301 to twist in the Z direction. As the operator stops twisting the skateboard body 300 the torsional stiffness of the adjustable torsional stiffness truck 1 pushes the skateboard body 300 back to an untwisted state. For completeness the skateboard 301 is supported by the ground 400 or any other suitable surface. The adjustable torsional stiffness skateboard truck 1 pushes against the ground 400 during twisting and untwisting of the skateboard body 300.

Figure 2:
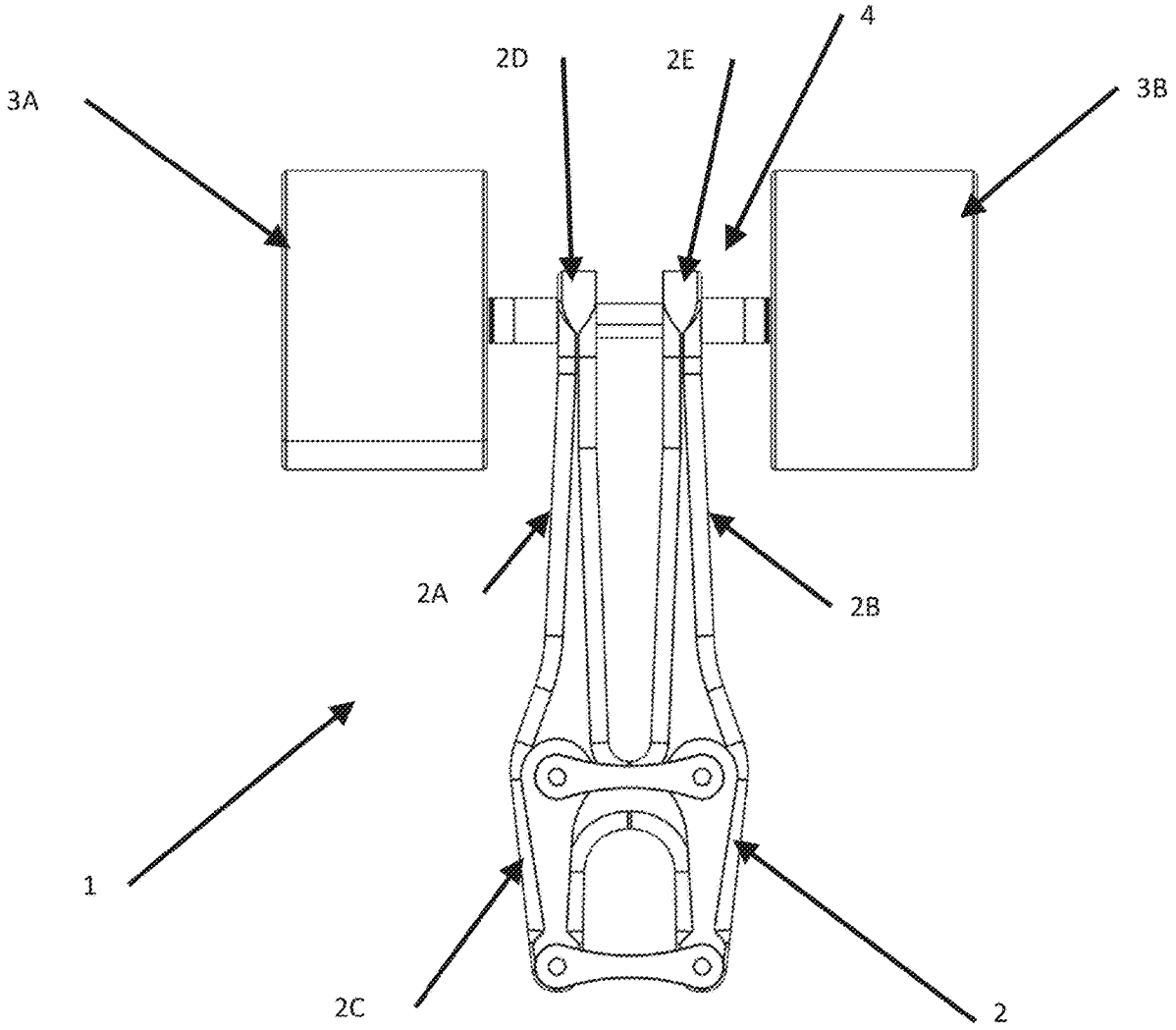
FIG. 2 depicts a variable torsion skateboard truck.

A skateboard truck 1 is shown in FIG. 2, in a broad overview, this skateboard truck 1 includes, wheels 3A and 3B rotationally attached to the axle assembly 4. A fork shaped structural arm 2 with tongs 2A and 2B are connected at the truck attachment end 2C. This truck attachment end 2C may be attached to the skateboard body 300 either directly or through additional components. This attachment provides a means of transferring force from the skateboard body 301 to the skateboard truck 1.

The applicant has found that adjusting axial tension on the axle 5 the torsional stiffness of the skateboard truck 1 can be adjusted. The tongs 2A and 2B are integral parts of the fork structure 2. This fork shaped structural arm 2 is attached to the skateboard body 300 in the attachment end 2C. The tongs 2A and 2B have distal ends 2D and 2E respectively and include co-axial holes on each distal end 2D and 2E. The axle is held in a tensioned state, this will cause the torsional stiffness of the adjustable torsional stiffness skateboard truck 1 to change. In some embodiments the axle assembly 4 is tensioned by deflecting and holding the distal ends 2D and 2E.

Figure 3:
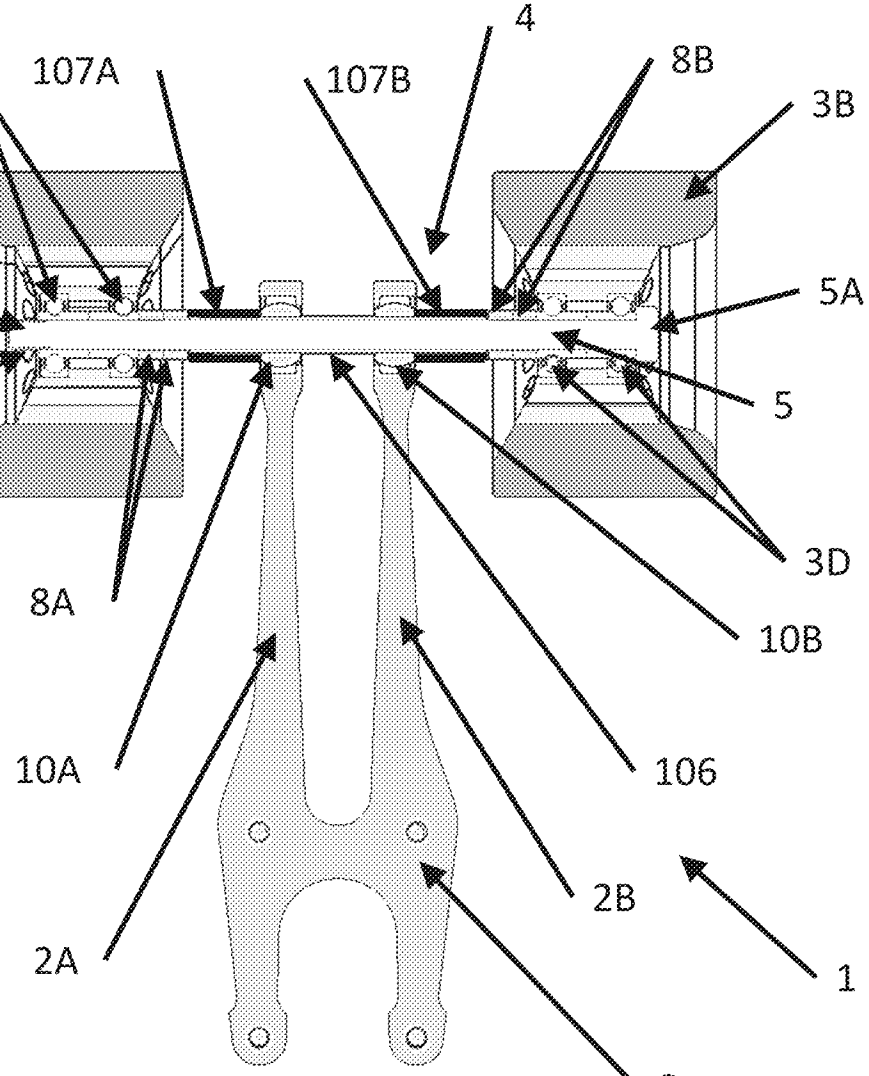
FIG. 3 depicts cross sectional view of a variable torsion skateboard truck.

FIG. 3 shows a cross section of an adjustable torsional stiffness skateboard truck 1. In some embodiments the wheels 3A and 3B include support bearings 3C and 3D respectively. These bearings allow the wheels 3A and 3B to rotate relative to the axle 5. In the conventional method the axle supports the wheel by connection to the fork shaped structural arm 2 and as discussed above the fork shaped structural arm 2 is attached to the skateboard body 300.

The connection of the axle 5 to the fork structure 2 may provide several functions. As shown in FIG. 3, compliant support bushings, in this embodiment they are spherical bushings 10A and 10B are included in the distal ends 2D and 2E of the tongs 2A and 2B. The axle is supported by these spherical bushings, however these spherical bushings 10A and 10B allow for flexing of the axle 5 relative to the corresponding tong 2A or 2B. This provides the tongs 2A and 2B to carry a load perpendicular to the axle 5 and so supporting the skateboard body 300 when the wheels 3A and 3B are loaded against the ground 400.

FIG. 3 shows the axle 5 inserted through the wheel 3A and bearings 3C, through clamp spacers 8A, spacer 107A, compliant support bushings, in this embodiment they are spherical bushing 10A (included in the distal end 2D of the tong 2A), a stop spacer 106. At this point it is worth understanding that the stop spacer 106 is inserted inside the spherical bushing 10A between the axle 5 and the spherical bushing 10A and is also inserted in the spacer 107A. The axle 5 is also inserted though similar components for support by tong 2B. Specifically, the axle 5 inserted through the wheel 3B and bearings 3D, through clamp spacers 8A, spacer 107B, spherical bushing 10B (included in the distal end 2D of the tong 2B), a stop spacer 106. Again, the stop spacer 106 is inserted inside the spherical bushing 10B between the axle 5 and the spherical bushing 10B and is also inserted in the spacer 107B.

Figure 3A:
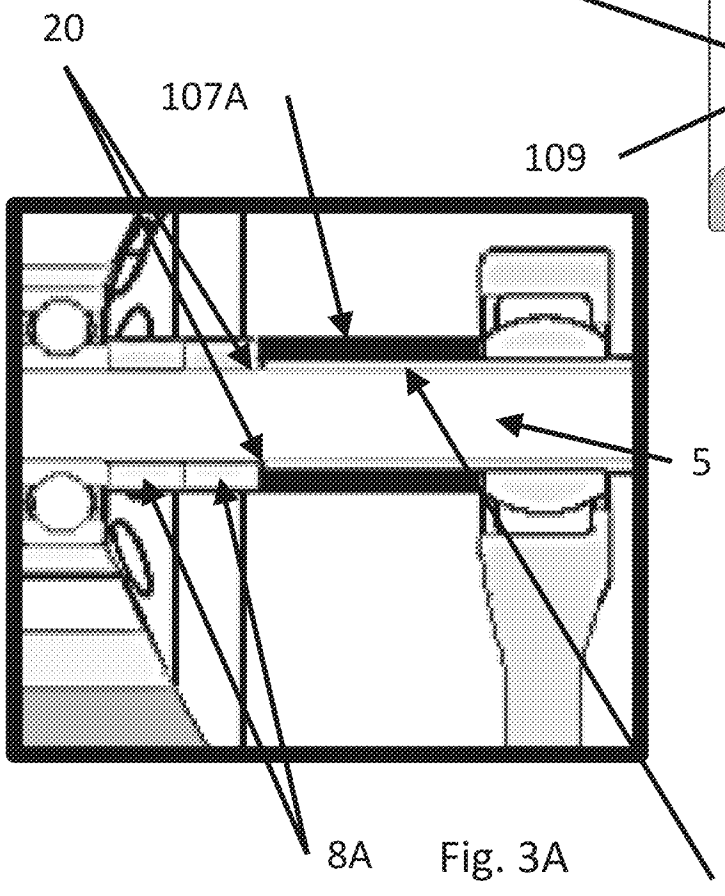
FIG. 3A depicts a detail of the adjustment space of the variable torsion skateboard truck of FIG. 3.

As shown in FIG. 3 the axle 5 includes a means of clamping the wheels against each tong. This means may include an enlarged portion 5A which lands against the bearings 3D and on the opposing end of the axle 5 a threaded portion 5B is provided. A nut 109 is threadedly attached to the threaded portion 5B. As the nut 109 is screwed onto the end of the threaded portion 5B the wheels 3A and 3B, the clamp spacers 8A and 8B and the stop spacer 106 are pushed together. FIG. 3A shows an adjustment space 20 created by the lengths of the clamp spacers 8A and 8B, the stop spacer 106 and the bearings 3C and 3D.

As the nut 109 is tightened the space 20 is decreased and the tongs 2A and 2B are pulled together. This causes tension in the axle 5, which in turn affect the torsional stiffness of the skateboard truck 1. This axle tension places several of the parts discussed above in compression as they resist the tension in the axle. These compression parts are the bearings 3C, the clamp spacers 8A, spacer 107A, spherical bushing 10A, spherical bushing 10B, spacer 107B, clamp spacers 8B and bearings 3D. Also note in this embodiment the tongs 2A and 2B are slightly bent toward each other.

As can be appreciated, once the stop spacer 106 lands against the clamp spacers 8A and 8B the tongs 2A and 2B can no longer be deflected and so this is the end of the adjustment. This feature prevents an operator from deflecting the tongs 2A and 2B past their plastic stress limit causing permanent damage to the fork shaped structural arm 2.

This means of clamping the wheels against each tong 2A and 2B has been described as using a threaded portion and a nut 109, however several other means can be used. These means include a ratcheting lever with teeth, rivets, wedges, fluid cylinder piston arrangement, linear motor or leadscrew and nut.

Figure 4:
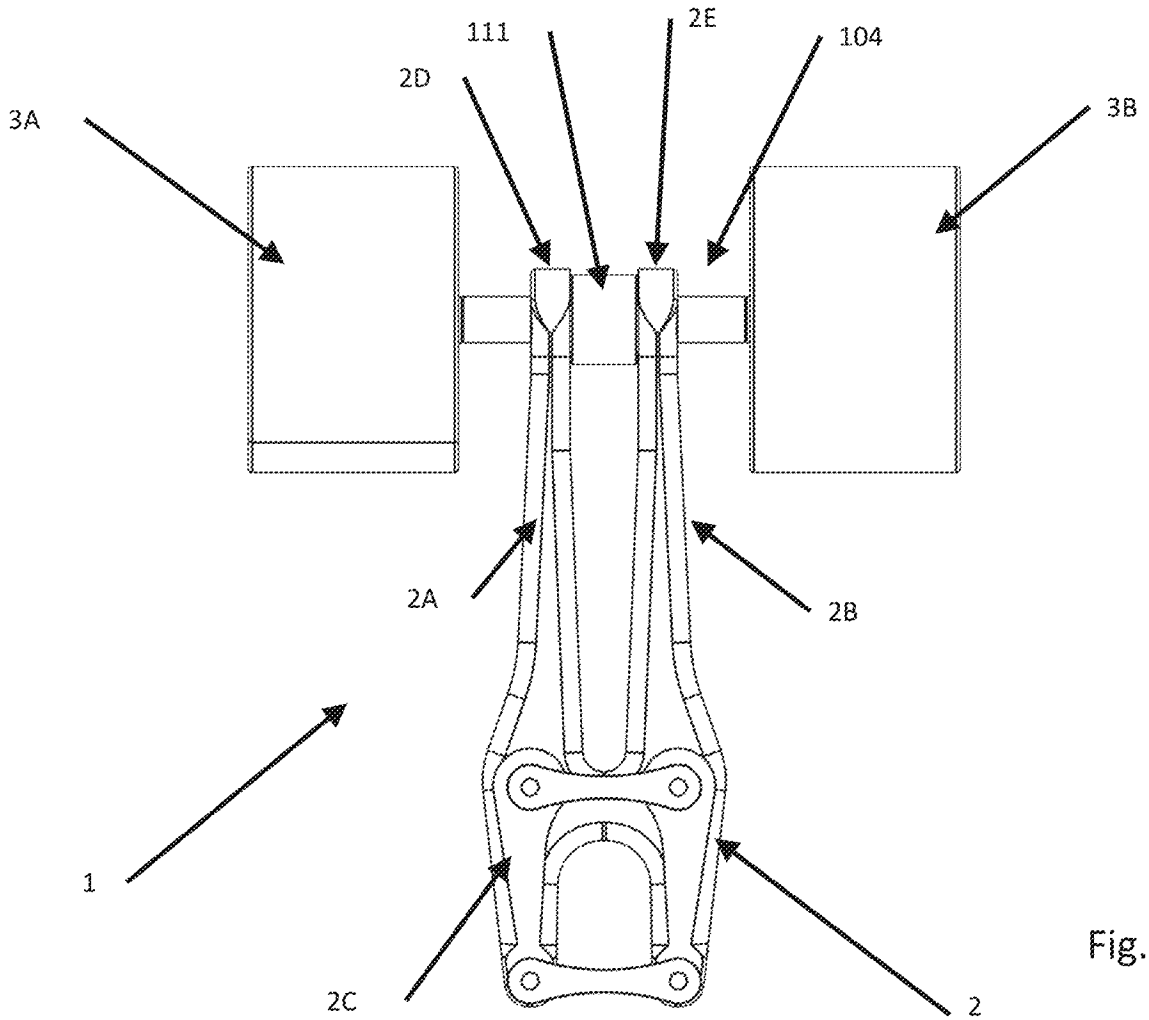
FIG. 4 depicts an embodiment of a variable torsion skateboard truck.

In the above embodiment, by tightening the axle 5 with the nut 109 the tongs 2A and 2B are deflected. In another embodiment, shown in FIG. 4, an adjustable torsional stiffness skateboard truck 1 with an axle assembly 104 that deflects the tongs 2A and 2B but includes a support bushing 111.

Figure 5:
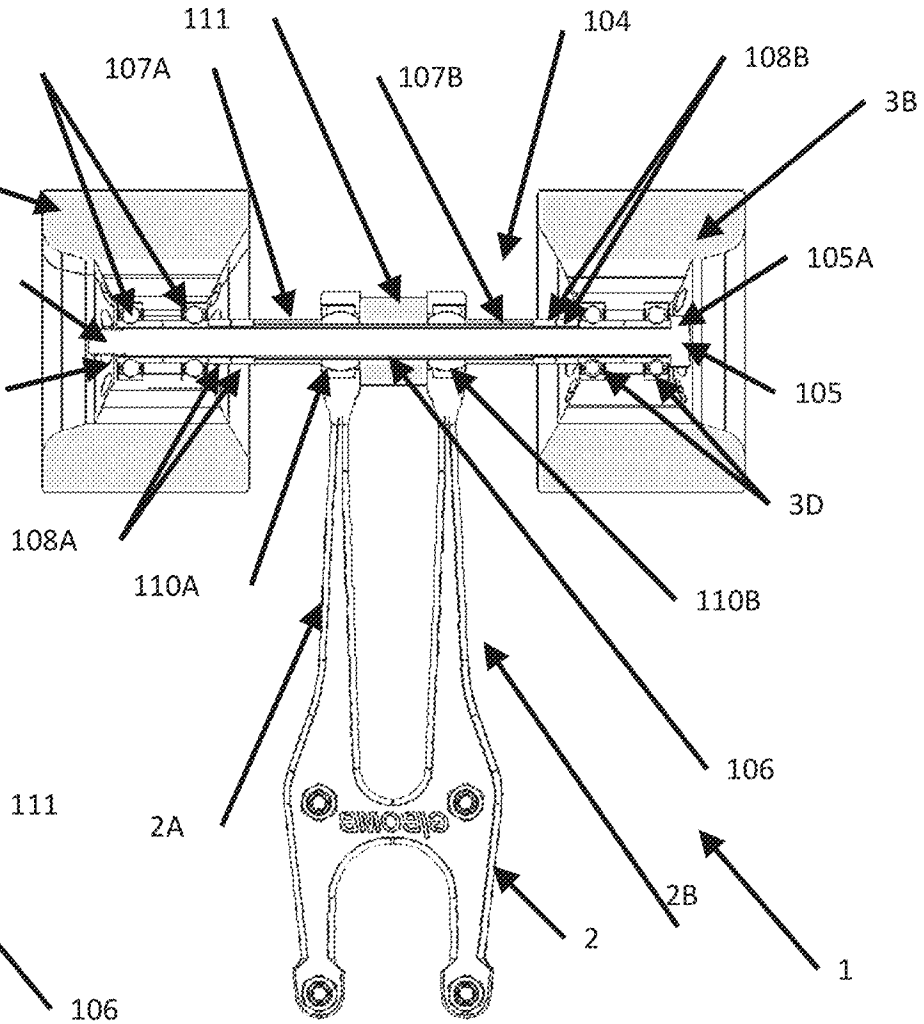
FIG. 5 depict a section view of a variable torsion skateboard truck embodiment.

FIG. 5 shows a cross section of an adjustable torsional stiffness skateboard truck 1. In some embodiments the wheels 3A and 3B include support bearings 3C and 3D respectively. These bearings 3C and 3D allow the wheels 3A and 3B to rotate relative to the axle 105. In the conventional method the axle 105 supports the wheel by connection to the fork shaped structural arm 2 and as discussed above the fork shaped structural arm 2 is attached to the skateboard body 300.

The connection of the axle 105 to the fork shaped structural arm 2 may provide several functions. As shown in FIG. 5, compliant support bushings, in this embodiment they are spherical bushings 110A and 110B are included in the distal ends 2D and 2E of the tongs 2A and 2B. The axle 105 is supported by these spherical bushings, however these spherical bushings 110A and 110B allow for flexing of the axle 105 relative to the corresponding tong 2A or 2B. This provides the tongs 2A and 2B to carry a load perpendicular to the axle 5 and so supporting the skateboard body 300 when the wheels 3A and 3B are loaded against the ground 400.

FIG. 5 shows the axle 105 inserted through the wheel 3A and bearings 3C, through clamp spacers 108A, spacer 107A, spherical bushing 110A (included in the distal end 2D of the tong 2A), a compliant spacer 111, a stop spacer 106. At this point it is worth understanding that the stop spacer 106 is inserted inside the spherical bushing 110A between the axle 5 and the spherical bushing 110A and is also inserted in the spacer 107A and the compliant spacer 111. The axle 105 is also inserted though similar components for support by tong 2B. Specifically, the axle 105 inserted through the wheel 3B and bearings 3D, through clamp spacers 108B, spacer 107B, spherical bushing 110B (included in the distal end 2D of the tong 2B), a stop spacer 106. Again, the stop spacer 106 is inserted inside the spherical bushing 110B between the axle 105 and the spherical bushing 110B and is also inserted in the spacer 107B.

Figure 5A:
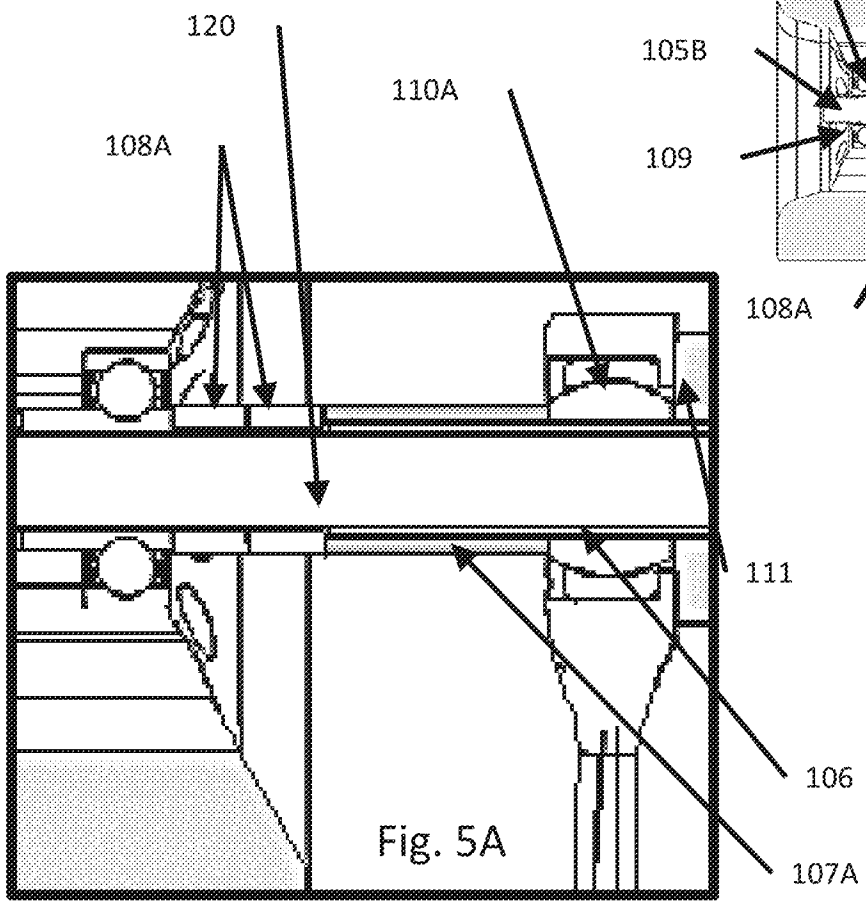
FIG. 5A depicts a detail of the adjustment space of the variable torsion skateboard truck of FIG. 5.

As shown in FIG. 5 the axle 105 includes a means of clamping the wheels against each tong. This means may include an enlarged portion 105A which lands against the bearings 3D and on the opposing end of the axle 105 a threaded portion 105B is provided. A nut 109 is threadedly attached to the threaded portion 105B. As the nut 109 is screwed onto the end of the threaded portion 105B the wheels 3A and 3B, the clamp spacers 108A and 108B and the stop spacer 106 are pushed together. FIG. 5A shows an adjustment space 120 created by the lengths of the clamp spacers 108A and 108B, the stop spacer 106 and the bearings 3C and 3D.

As the nut 109 is tightened the space 120 is decreased and the tongs 2A and 2B are pulled together. This causes tension in the axle 5, which in turn affect the torsional stiffness of the skateboard truck 1. This axle tension places several of the parts discussed above in compression as they resist the tension in the axle. These compression parts are the bearings 3C, the clamp spacers 108A, spacer 107A, spherical bushing 110A, support bushing 111, spherical bushing 110B, spacer 107B, clamp spacers 108B and bearings 3D. Also note in this embodiment the tongs 2A and 2B are slightly bent toward each other.

Once the stop spacer 106 lands against the clamp spacers 108A and 108B the tongs 2A and 2B can no longer be deflected and so this is the end of the adjustment. This feature prevents an operator from deflecting the tongs 2A and 2B past their plastic stress limit causing permanent damage to the fork shaped structural arm 2.

Figure 6:
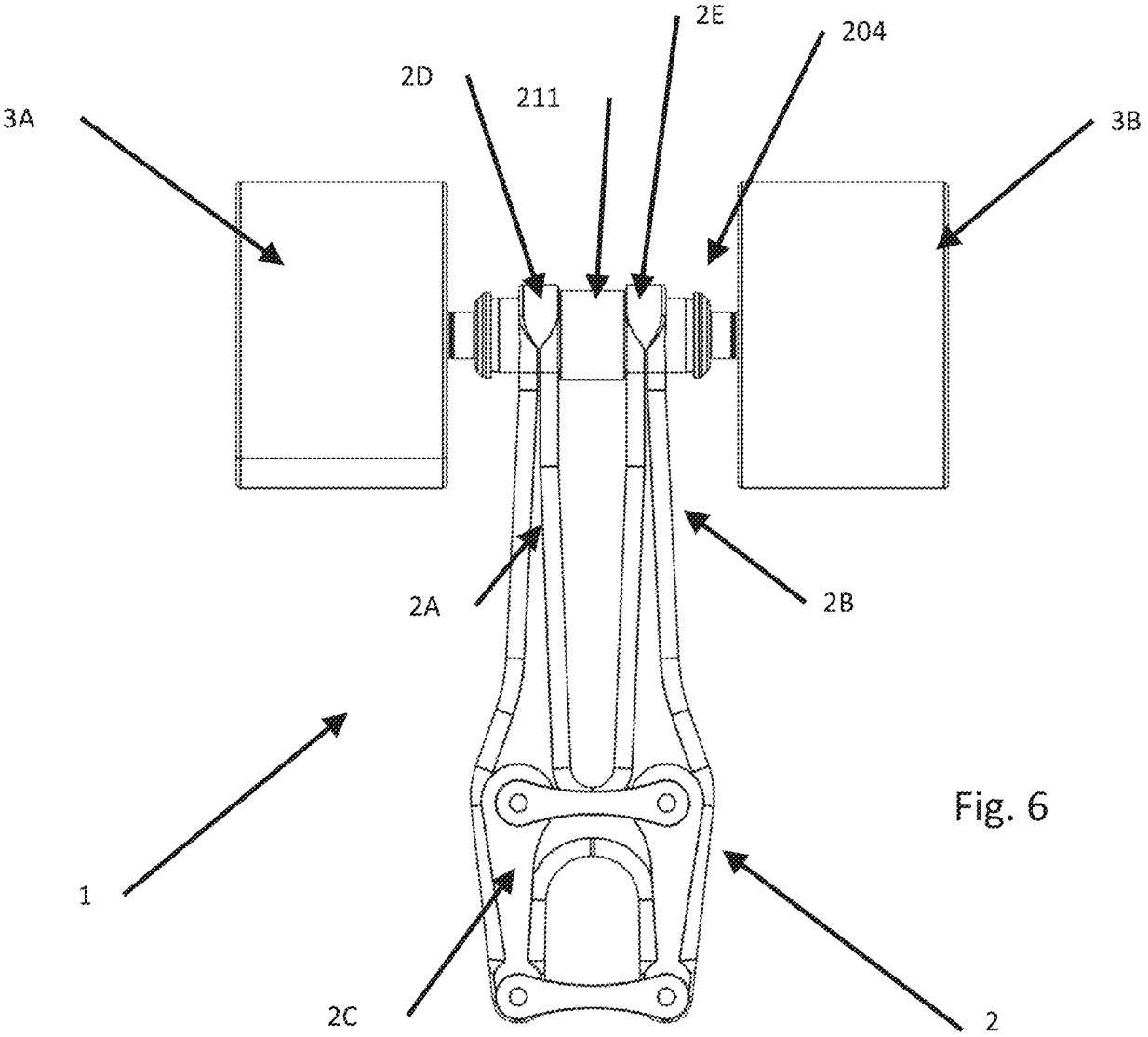
FIG. 6. depicts an embodiment of a variable torsion skateboard truck.

In another embodiment, shown in FIG. 6, an adjustable torsional stiffness skateboard truck 1 with an axle assembly 204 that deflects the tongs 2A and 2B but includes a support bushing 211 and compliant bushings 210A and 210B.

Figure 7:
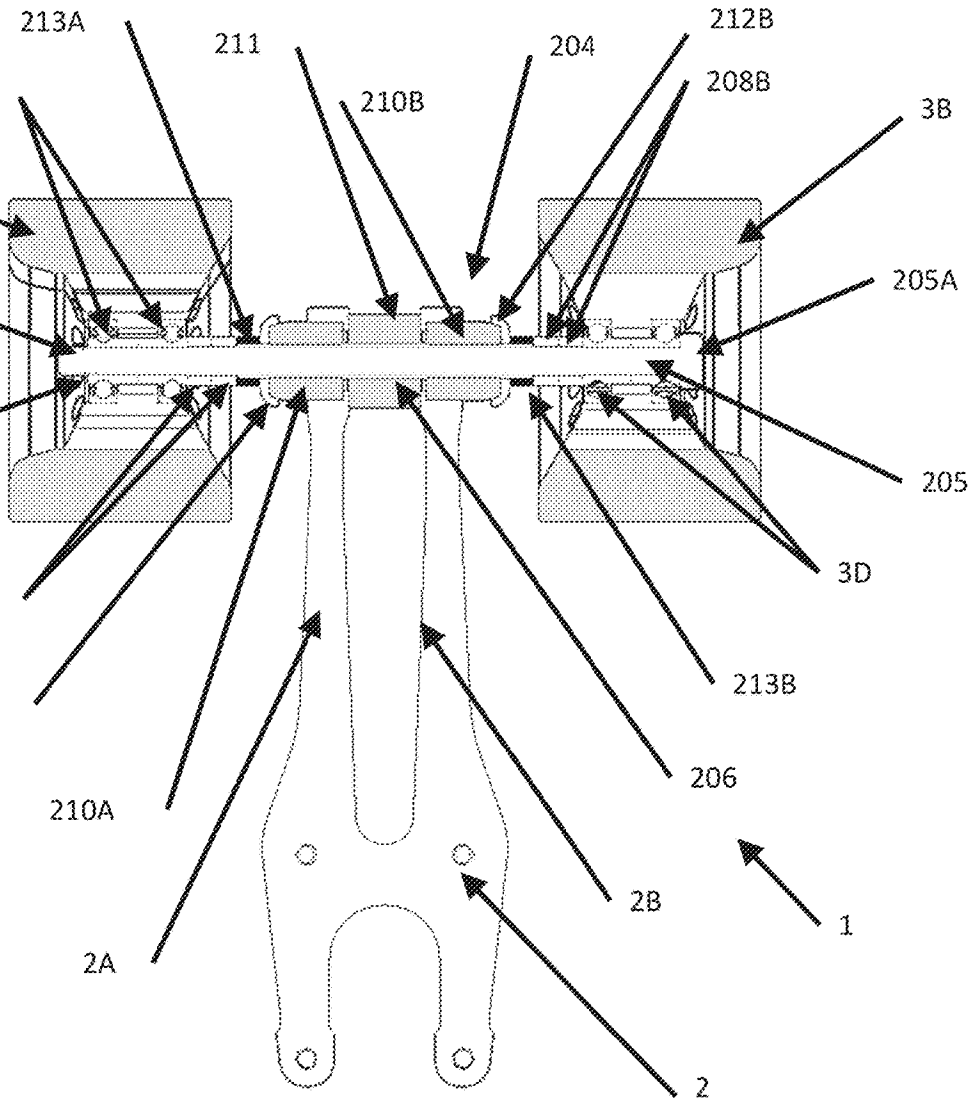
FIG. 7 depicts an embodiment of a variable torsion skateboard truck.

FIG. 7 depicts a cross section of an additional embodiment. Most notably, the compliance bushings are compliant bushings 210A and 210B and a support bushing 211.

FIG. 7 shows a cross section of an adjustable torsional stiffness skateboard truck 1. In some embodiments the wheels 3A and 3B include support bearings 3C and 3D respectively. These bearings allow the wheels 3A and 3B to rotate relative to the axle 205. In the conventional method the axle 205 supports the wheel 3A and 3B by connection to the fork shaped structural arm 2 and as discussed above the fork shaped structural arm 2 is attached to the skateboard body 300.

The connection of the axle 205 to the fork shaped structural arm 2 may provide several functions. As shown in FIG. 7, compliant bushings 210A and 210B are included in the distal ends 2D and 2E of the tongs 2A and 2B. The axle 205 is supported by these compliant bushings 210A and 210B, however these compliant bushings 210A and 210B allow for flexing of the axle 205 relative to the corresponding tong 2A or 2B. This provides the tongs 2A and 2B to carry a load perpendicular to the axle 205 and so supporting the skateboard body 300 when the wheels 3A and 3B are loaded against the ground 400.

FIG. 7 shows the axle 205 inserted through the wheel 3A and bearings 3C, through clamp spacers 208A, spacer 213A, washer 212A, compliant bushing 210A (included in the distal end 2D of the tong 2A), a stop spacer 206. At this point it is worth understanding that the stop spacer 206 is inserted inside the compliant bushing 210A and the washer 212A, between the axle 205 and the compliant bushing 210A and is also inserted in the spacer 213A. The axle 205 is also inserted though similar components for support by tong 2B. Specifically, the axle 205 inserted through the wheel 3B and bearings 3D, through clamp spacers 208B, spacer 213B, washer 212B compliant bushing 210B (included in the distal end 2D of the tong 2B), a stop spacer 206. Again, the stop spacer 206 is inserted inside the compliant bushing 210B between the axle 5 and the compliant bushing 210B and is also inserted in the spacer 213B.

Figure 7A:
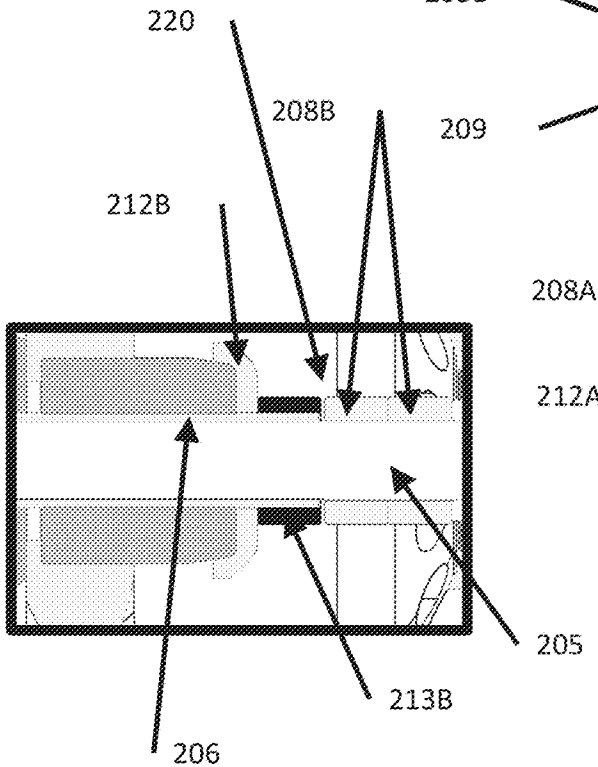
FIG. 7A depicts a detail of the adjustment space of the variable torsion skateboard truck of FIG. 7.

As shown in FIG. 7 the axle 205 includes a means of clamping the wheels against each tong. This means may include an enlarged portion 205A which lands against the bearings 3D and on the opposing end of the axle 205 a threaded portion 205B is provided. On the opposing end of the axle 205 a threaded portion 205B is provided. A nut 209 is threadedly attached to the threaded portion 205B. As the nut 209 is screwed onto the threaded portion 205B the wheels 3A and 3B, the clamp spacers 208A and 208B and the stop spacer 206 are pushed together. FIG. 7A shows an adjustment space 220 created by the lengths of the clamp spacers 208A and 208B, the stop spacer 206 and the bearings 3C and 3D.

As the nut 209 is tightened the space 220 is decreased and the tongs 2A and 2B are pulled together. This causes tension in the axle 205, which in turn affect the torsional stiffness of the skateboard truck 1. This axle tension places several of the parts discussed above in compression as they resist the tension in the axle 205. These compression parts are the bearings 3C, the clamp spacers 208A, spacer 213A, compliant bushing 210A, support bushing 211, compliant bushing 210B, spacer 213B, clamp spacers 208B and bearings 3D. Also note in this embodiment the tongs 2A and 2B are slightly bent toward each other.

As can be appreciated, once the stop spacer 206 lands against the clamp spacers 208A and 208B the tongs 2A and 2B can no longer be deflected and so this is the end of the adjustment. This feature prevents an operator from deflecting the tongs 2A and 2B past their plastic stress limit causing permanent damage to the fork shaped structural arm 2. This damage can include both plastic deformation and breakage of the fork shaped structural arm 2 due to metal fatigue.

Figure 9:
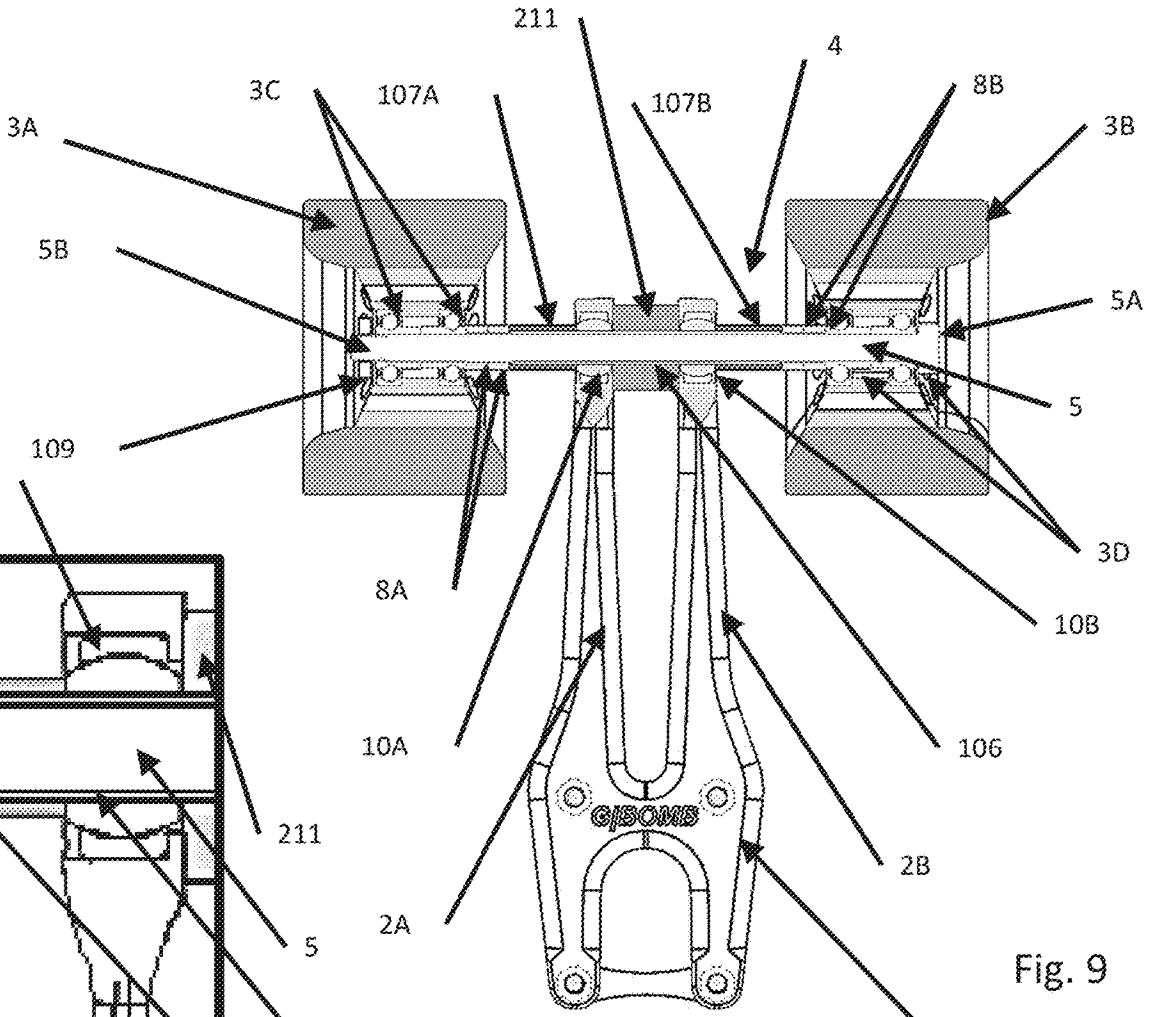
FIG. 9 depicts a cross section view of an embodiment of a variable torsion skateboard with compliant spacer.

FIG. 9 shows a cross section of an adjustable torsional stiffness skateboard truck 1 embodiment. In some embodiments the wheels 3A and 3B include support bearings 3C and 3D respectively. These bearings allow the wheels 3A and 3B to rotate relative to the axle 5. In the conventional method the axle supports the wheel by connection to the fork shaped structural arm 2 and as discussed above the fork shaped structural arm 2 is attached to the skateboard body 300.

Figure 8:
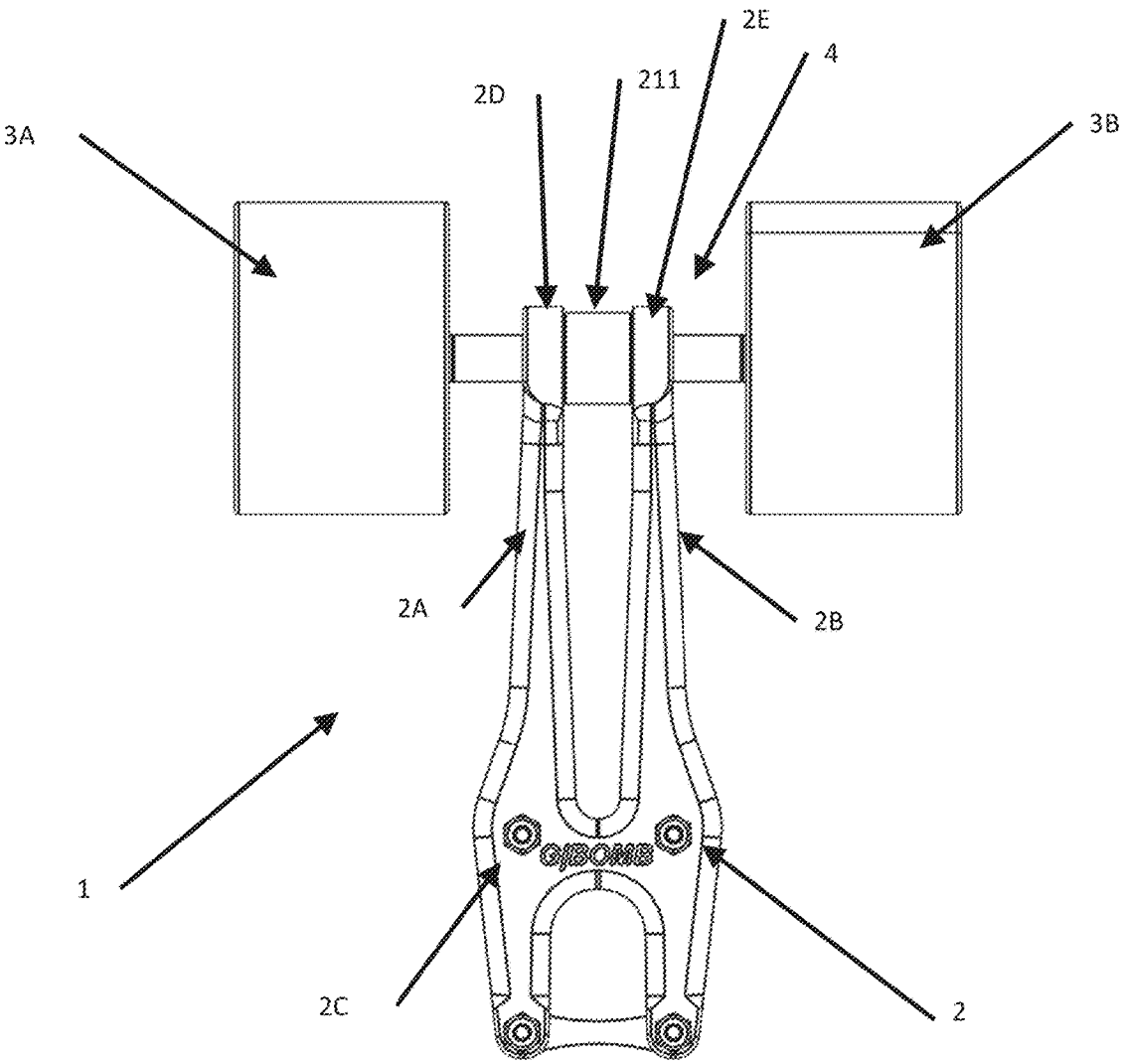
FIG. 8 depicts an embodiment of a variable torsion skateboard with a compliant spacer.

The connection of the axle 5 to the fork shaped structural arm 2 may provide several functions. As shown in FIG. 9, spherical bushings 10A and 10B are included in the distal ends 2D and 2E of the tongs 2A and 2B as shown in FIG. 8. The axle 5 is supported by these spherical bushings 10A and 10B, additionally these spherical bushings 10A and 10B allow for flexing of the axle 5 relative to the corresponding tong 2A or 2B. This provides the tongs 2A and 2B to carry a load perpendicular to the axle 5 and so supporting the skateboard body 300 when the wheels 3A and 3B are loaded against the ground 400.

FIG. 9 shows the axle 5 inserted through the wheel 3A and bearings 3C, through clamp spacers 8A, spacer 107A, spherical bushing 10A (included in the distal end 2D of the tong 2A), a stop spacer 106. At this point it is worth understanding that the stop spacer 106 is inserted inside the spherical bushing 10A between the axle 5 and the spherical bushing 10A and is also inserted in the spacer 107A. Also, as can be seen in FIG. 9, a support bushing 211 is located coaxially with the axle between the tongs 2A and 2B and on the out of the stop spacer 106. The axle 5 is also inserted though similar components for support by tong 2B. Specifically, the axle 5 inserted through the wheel 3B and bearings 3D, through clamp spacers 8A, spacer 107B, spherical bushing 10B (included in the distal end 2D of the tong 2B), a stop spacer 106. Again, the stop spacer 106 is inserted inside the spherical bushing 10B between the axle 5 and the spherical bushing 10B and is also inserted in the spacer 107B.

As can be appreciated, once the stop spacer 106 lands against the clamp spacers 8A and 8B the tongs 2A and 2B can no longer be deflected and so this is the end of the adjustment. This feature prevents an operator from deflecting the tongs 2A and 2B past their plastic stress limit causing permanent damage to the fork shaped structural arm 2.

An advantage of this embodiment is that the tension in the axle can be increased for a specific amount of compression of the parts. Again, this embodiment allows a range of torsional stiffness from which the user can adjust and use.

Figure 9A:
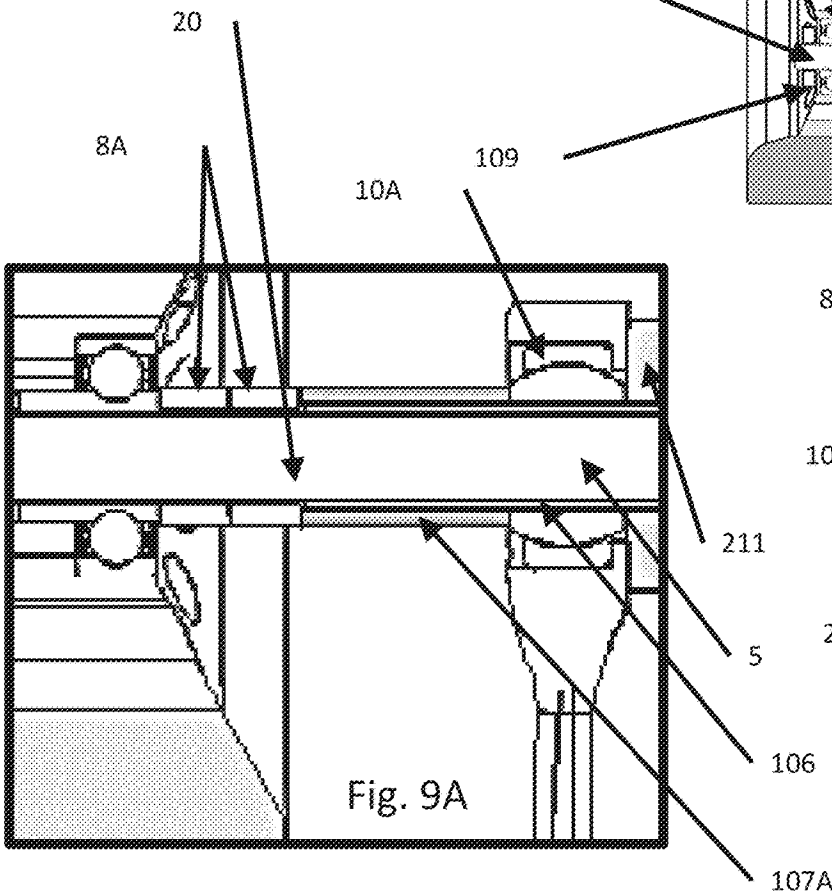
FIG. 9A depicts a detail of the adjustment space of the variable torsion skateboard truck of FIG. 9.

As shown in FIGS. 9 and 9A, the axle 5 includes a means of clamping the wheels against each tong. This means may include an enlarged portion 5A which lands against the bearings 3D and on the opposing end of the axle 5 a threaded portion 5B is provided. A nut 109 is threadedly attached to the threaded portion 5B. As the nut 109 is screwed onto the end of the threaded portion 5B the wheels 3A and 3B, the clamp spacers 8A and 8B and the stop spacer 106 are pushed together. FIG. 3A shows an adjustment space 20 created by the lengths of the clamp spacers 8A and 8B, the stop spacer 106 and the bearings 3C and 3D.

As the nut 109 is tightened the space 20 is decreased and the tongs 2A and 2B are pulled together. This causes tension in the axle 5, which in turn affect the torsional stiffness of the skateboard truck 1. This axle tension places several of the parts discussed above in compression as they resist the tension in the axle 5. These compression parts are the bearings 3C, the clamp spacers 8A, spacer 107A, spherical bushing 10A, support bushing 211, spherical bushing 10B, spacer 107B, clamp spacers 8B and bearings 3D. Also note in this embodiment the tongs 2A and 2B are slightly bent toward each other.

As can be appreciated, once the stop spacer 106 lands against the clamp spacers 8A and 8B the tongs 2A and 2B can no longer be deflected and so this is the end of the adjustment. This feature prevents an operator from deflecting the tongs 2A and 2B past their plastic stress limit causing permanent damage to the fork shaped structural arm 2.

In the above embodiment, by tightening the axle 5 with the nut 109 the tongs 2A and 2B are deflected. In another embodiment, shown in FIG. 4, an adjustable torsional stiffness skateboard truck 1 with an axle assembly 104 that deflects the tongs 2A and 2B but includes a support bushing 111. Again, this embodiment allows a range of torsional stiffness from which the user can adjust and use.

Figure 10:
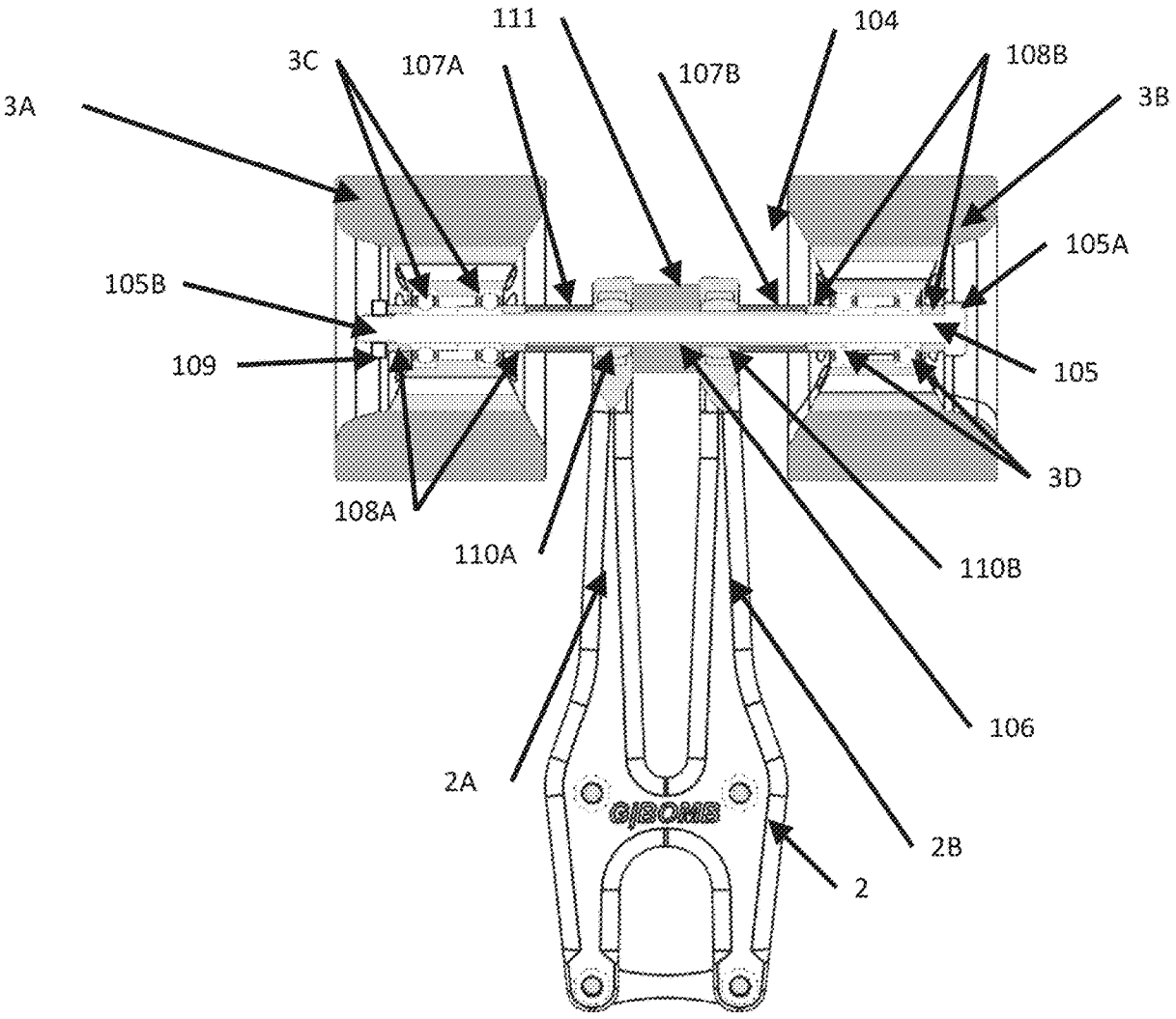
FIG. 10 depicts a cross sectional view of an embodiment of a variable torsion skateboard with compliant spacer and a narrowed wheel distance.
Figure 11:
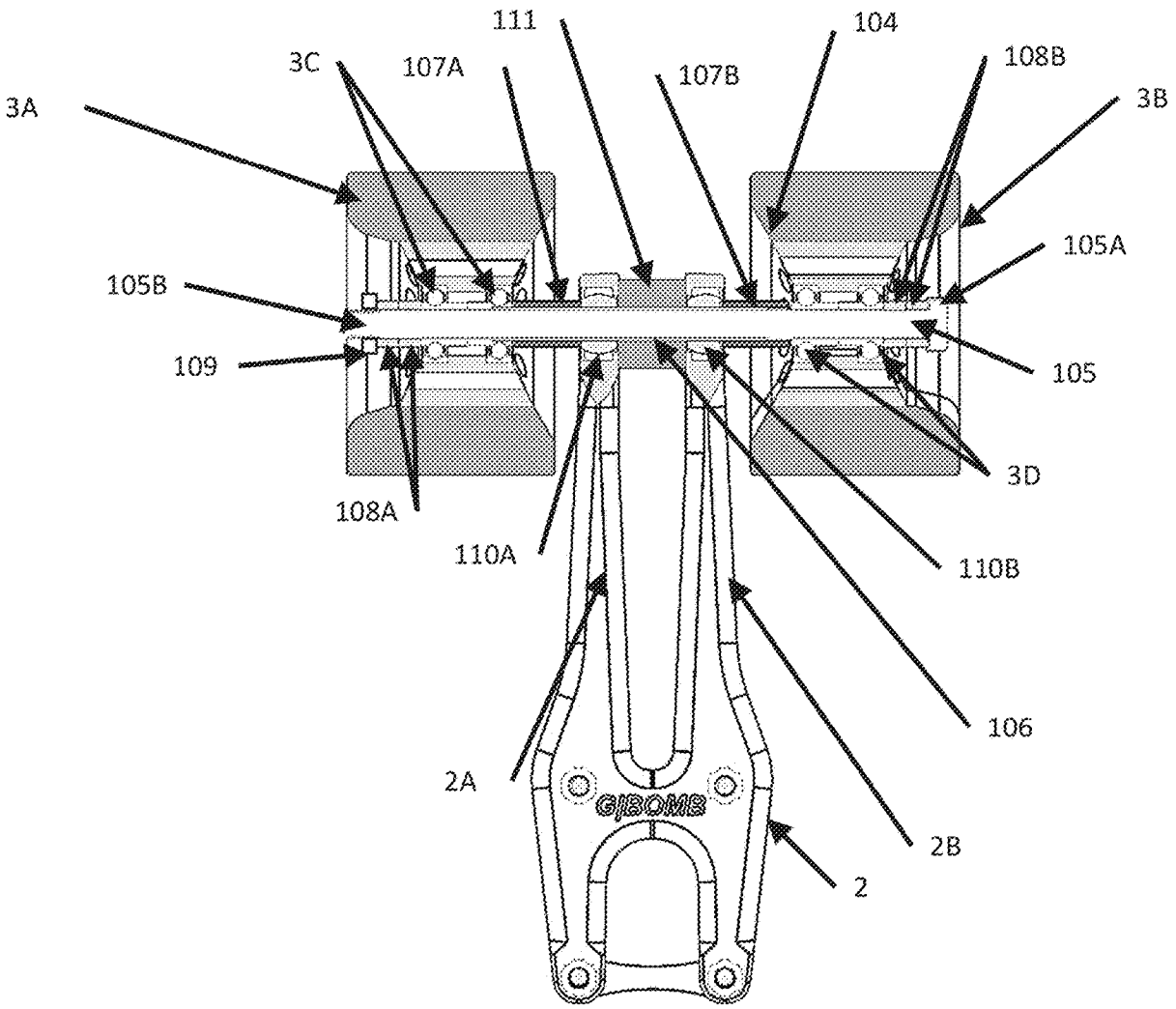
FIG. 11 depicts a cross sectional view of an embodiment of a variable torsion skateboard with compliant spacer and a narrowed wheel distance.

An additional factor that affects the torsional stiffness of a skateboard truck 1 is the distance between wheels on the same axle. Adjustment of the distance between wheels 3A and 3B are shown in FIGS. 10 and 11. In FIG. 10 the clamp spacers 108A are positioned on each end of the wheel 3A. This positioning results in reducing the distance of wheel 3A from tong 2A. Likewise FIG. 10 shows the clamp spacers 108B are also positioned on each end of the wheel 3B. This positioning results in reducing the distance of wheel 3B from tong 2B. Additionally, this wheel distance adjustment allows an operator the ability to narrow the distance between the wheels 3A and 3B so they are less likely to hit the wheels 3A and 3B while pushing with a foot.

As can be seen in FIG. 11, the wheels 3A and 3B can be positioned even closer to the respective tongs 2A and 2B by placing both clamp spacers 108A and 108B outside of each wheel 3A and 3B. Also notice that the same result can be achieved by simply removing the clamp spacers 108A and 108B from the apparatus and tightening the nut 109 further along the axle 1.

As can be appreciated, once the stop spacer 106 lands against the spacers 207A and 207B the tongs 2A and 2B can no longer be deflected and so this is the end of the adjustment. This feature prevents an operator from deflecting the tongs 2A and 2B past their plastic stress limit causing permanent damage to the fork shaped structural arm 2.

In another embodiment, the clamp spacers 108A and 108B may be positioned asymmetrically. For example, the clamp spacers 108A could be positioned outside wheel 3A and clamp spacer 108B could be positioned inside wheel 3B. The advantage of this embodiment is that each side can have a different axle tension and so the torsional stiffness can be different depending on which direction the user twists the skateboard 301. This would depend on the user's preference.

Figure 16:
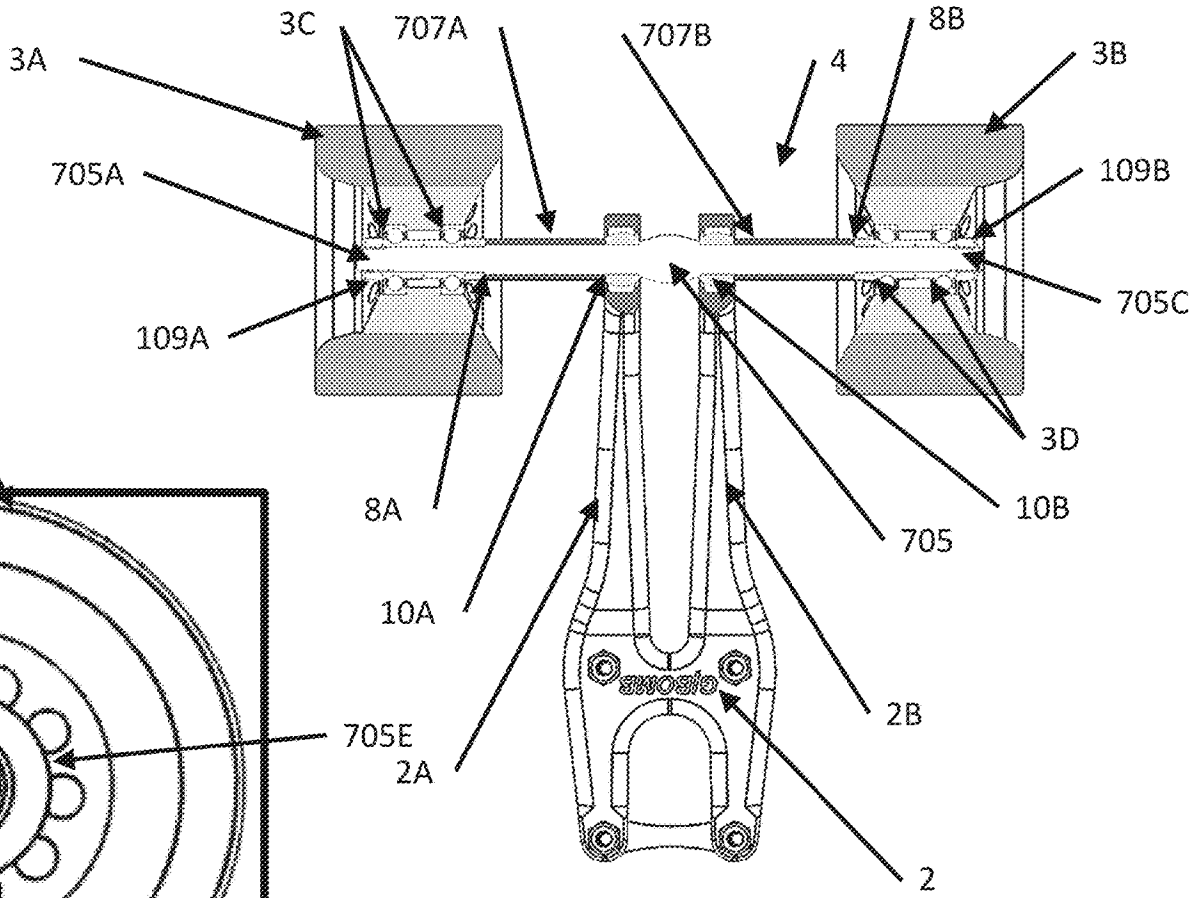
FIG. 16 depicts a cross sectional view of and embodiment of a variable torsion skateboard with a dual threaded axle.
Figure 17:
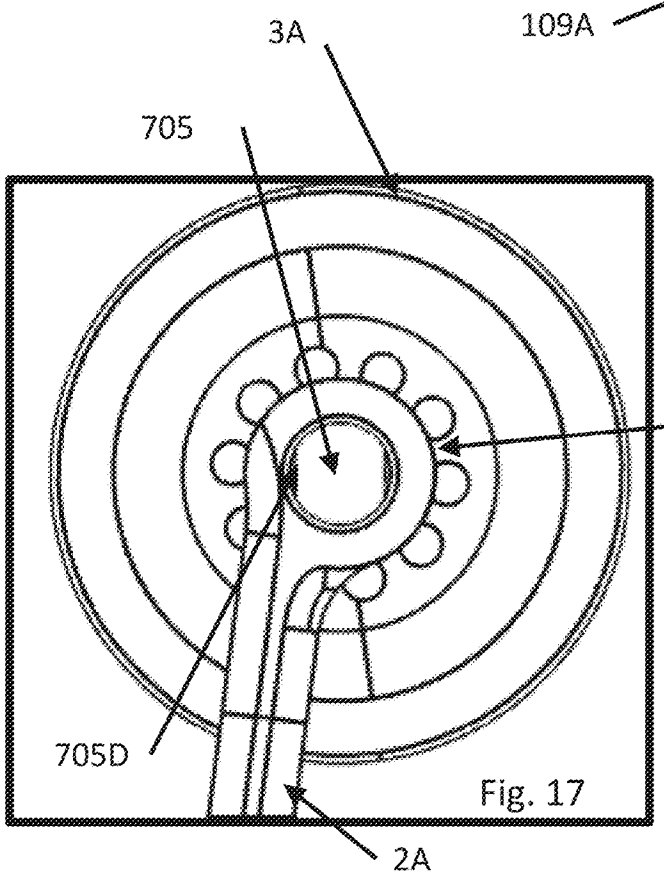
FIG. 17 depicts a cross section view of the dual threaded axle showing flats on the opposing sides.
Figure 18:
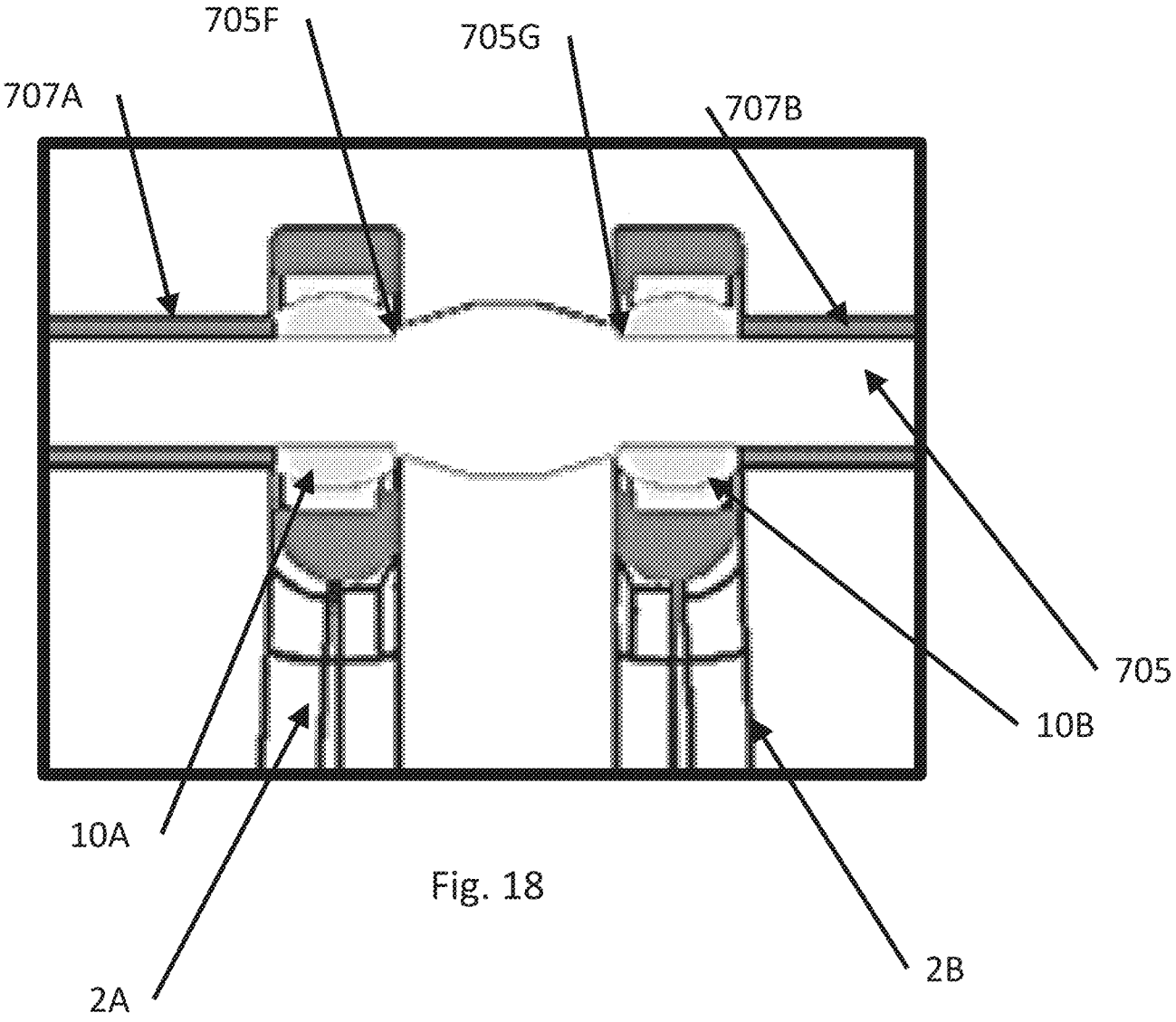
FIG. 18 depicts a larger view of the dual threaded axle of FIG. 16, showing stop shoulders.

An additional embodiment is shown in FIGS. 16-18. The axle 705 includes two threaded ends 705A and 705C. Two nuts 109A and 109B are threadedly attached at the two threaded ends 705A and 705C. FIG. 17 shows two flats 705D and 705E, these flats 705D and 705E allow the user hold the axle 705 from rotating as the nuts 109A and 109B are assembled.

FIG. 18 shows stop shoulders 705F and 705G that contact the spherical bushings 10A and 10B. As the nuts 109A and 109B are tightened the axle 705 is tensioned. As explained above this tensioning has been found to change the torsional stiffness of the skateboard truck 1. The advantage of this embodiment is that each side can have a different axle tension and so the torsional stiffness can be different depending on which direction the user twists the skateboard 301. This also reduces the parts required for assembly which is an advantage as less parts need to be manufactured reducing cost, less parts for a user to forget when reassembling and this prevents the operator from removing a part which if not used could cause the fork shaped structural arm 2 to be damaged when tensioning the axle 5.

Figure 12:
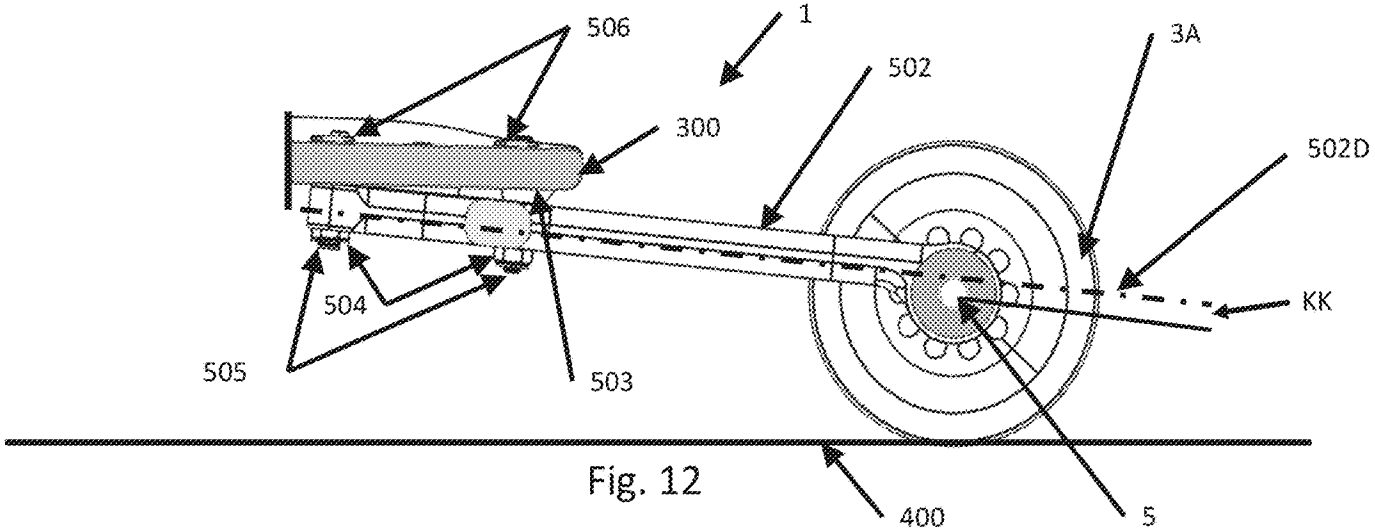
FIG. 12 depicts a cross sectional view of an embodiment of a variable torsion skateboard with a compliant spacer and a straight fork shaped structural arm.
Figure 13:
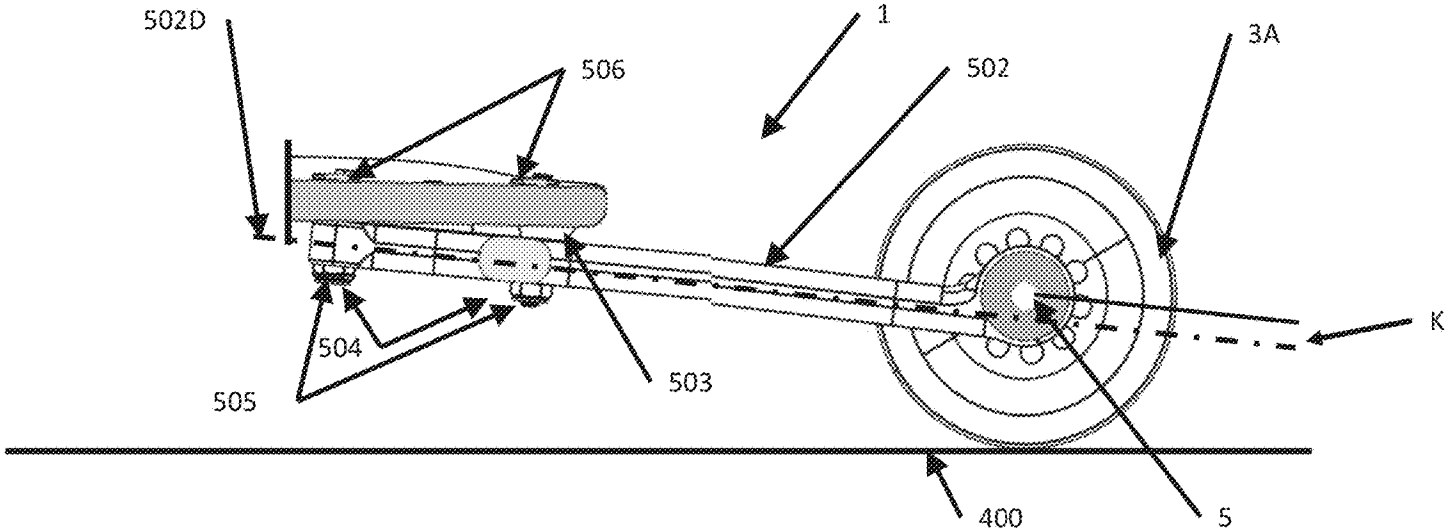
FIG. 13 depicts a cross sectional view of an embodiment of a variable torsion skateboard with a compliant spacer and a straight fork shaped structural arm, mounted in an inverted configuration.

An additional embodiment is explained by referring to FIGS. 12 and 13. FIG. 12 shows a cross sectional view of a variable torsional skateboard truck 1 with a straight fork shaped structural arm 502. As can be seen the fork shaped structural arm 502 is mounted with an angle spacer 503. In this configuration the axle 5 is below the attachment end 2C centerline 502D by a distance KK. FIG. 13 shows the variable torsional skateboard truck 1 in an inverted configuration. In this configuration the axle 5 is above the attachment end 2C centerline 502D by a distance K. This causes the distance of the skateboard body 300 to be a different distance from the ground 400. These configurations are used to adjust the height of the skateboard body 300 without the need of any additional components. As can be seen in the FIGS. 12 and 13 the fork shaped structural arm 502 is attached to the skateboard body 1 with plates 506, threaded rods 505 connected to the plates 506 and mounting nuts 504. Other means of mounting the fork shaped structural arm 502 can easily be provided such as clamps, rivets and adhesives. An advantage of the plates 506, threaded rods 505 and mounting nuts 504 is that the user can easily convert the configuration to allow for different use environments.

Figure 14:
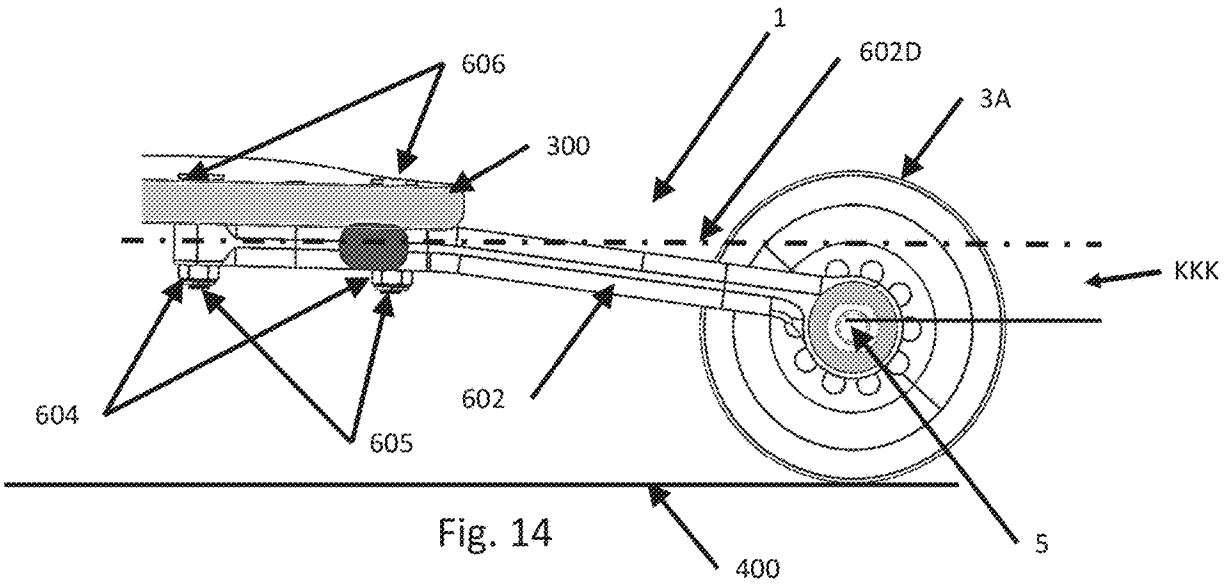
FIG. 14 depicts a cross sectional view of an embodiment of a variable torsion skateboard with a compliant spacer and a bent fork shaped structural arm.
Figure 15:
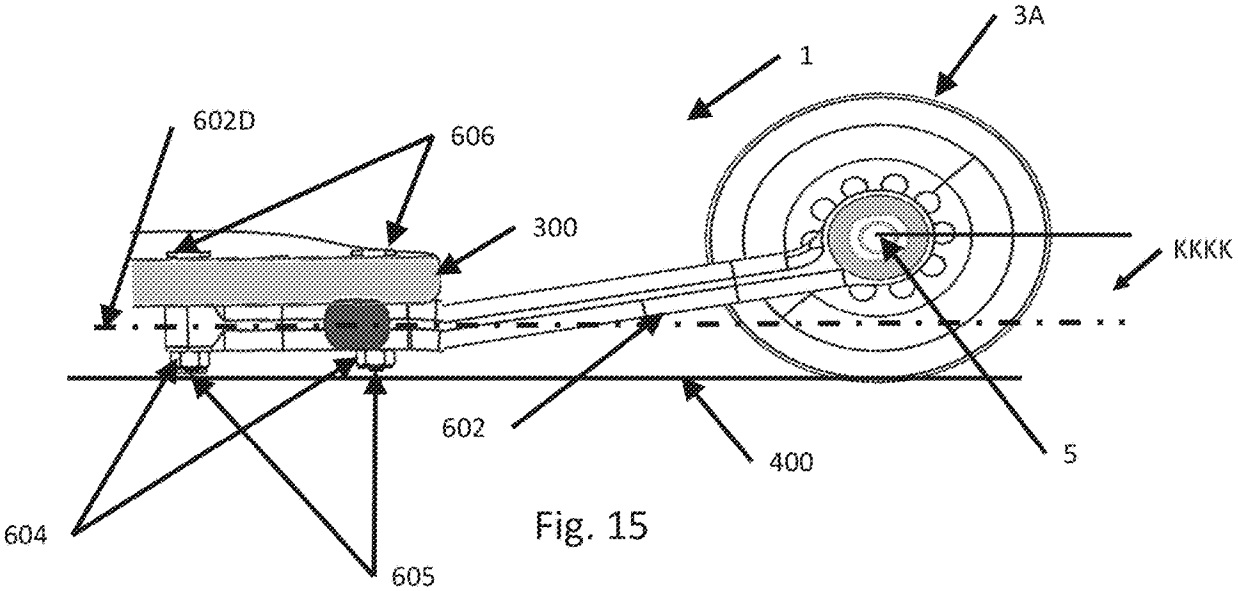
FIG. 15 depicts a cross sectional view of an embodiment of a variable torsion skateboard with a compliant spacer and a bent fork shaped structural arm, mounted in an inverted configuration.

An additional embodiment is explained by referring to FIGS. 14 and 15. FIG. 14 shows a cross sectional view of a variable torsional skateboard truck 1 with a bent fork shaped structural arm 602. As can be seen the fork shaped structural arm 602 is mounted on the skateboard body 300. The fork shaped structural arm 602 bends downward as it extends to the axle location. This provides distance between the ground 400 and the skateboard body 300. In this configuration the axle 5 is below the attachment end 2C centerline 602D by a distance KKK. FIG. 15 shows the variable torsional skateboard truck 1 in an inverted configuration. In this configuration the axle 5 is above the attachment end 2C centerline 602D by a distance KKKK. This causes the distance of the skateboard body 300 to be a different distance from the ground 400. These configurations are used to adjust the height of the skateboard body 1 without the need of any additional components. As can be seen in the FIGS. 14 and 15 the fork shaped structural arm 602 is attached to the skateboard body 1 with plates 606, threaded rods 605 and mounting nuts 604. Other means of mounting the fork shaped structural arm 602 can easily be provided such as clamps, rivets and adhesives. An advantage of the plates 606, threaded rods 605 and mounting nuts 604 is that the user can easily convert the configuration to allow for different use environments.

It should be noticed that the FIGS. 12-15 depict a variable torsional stiffness skateboard truck 1 with a support bushing 111 or 211. However, any of the above embodiments allow for configuration of the fork shaped structural arm 502, 602 in the shown configuration and an inverted configuration.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary embodiments were chosen and described in order to best explain the principles of the present technology and its practical application, and to enable others of ordinary skill in the art to understand the present technology for various embodiments with various modifications as are suited to the particular use contemplated.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present. The description herein is illustrative and not restrictive. Many variations of the technology will become apparent to those of skill in the art upon review of this disclosure.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

I claim:

1. An adjustable torsional stiffness skateboard truck comprising;

a fork shaped structural arm having two tongs, an attachment end for attachment to a skateboard, and having a compliant support bushing on the distal end of each tong, the two tongs being able to flex relative to each other such that they have a predetermined spring rate, an axle located in the compliance bushings and having a first end and a second end, two wheels coaxial with the axle and located against the outside of each tong such that the axle first end and second end extend outside the two wheels, a stop spacer located coaxially with the axle and between each tong, the stop spacer being of a length that prevents the tongs being deflected past a predetermined amount, and a means of clamping the wheels against each tong for loading the axle in tension.

2. The adjustable torsional stiffness skateboard truck of claim 1, further comprising a support bushing located coaxial with the stop spacer and between each tong for adding resistance to the means of clamping.

3. The adjustable torsional stiffness skateboard truck of claim 1, wherein the means of clamping the wheels against each tong for loading the axle in tension comprises an enlarged portion on the axle first end and a threaded portion on the second end and a nut installed on the threaded portion of the axle.

4. The adjustable torsional stiffness skateboard truck of claim 1, wherein the stop spacer is an integral feature of the axle.

5. The adjustable torsional stiffness skateboard truck of claim 4, wherein the stop spacer includes at least one flat such that the axle can be gripped for clamping the wheels.

6. The adjustable torsional stiffness skateboard truck of claim 4, wherein the means of clamping the wheels against each tong for loading the axle in tension comprises a threaded portion on the axle first end and a threaded portion on the second end and a nut installed on each threaded portion of the axle.

7. The adjustable torsional stiffness skateboard truck of claim 1, wherein the attachment end has a first attachment side and a second attachment side defining a centerline between the first and second attachment sides and the compliance bushing on the distal end of each tong is offset from the centerline, such that attachment to a surface on the first attachment side results in a first distance of the compliant support bushing on the distal end of each tong to the surface; and attachment on the second attachment side to the surface results in a second distance of the compliant support bushing on the distal end of each tong to the surface such that the first and second distances are not equal.

8. The adjustable torsional stiffness skateboard truck of claim 7, further comprising a support bushing located coaxial with the stop spacer and between each tong.

9. The adjustable torsional stiffness skateboard truck of claim 8, wherein the means of clamping the wheels against each tong for loading the axle in tension comprises an enlarged portion on the axle first end and a threaded portion on the second end and a nut installed on the threaded portion of the axle.

10. The adjustable torsional stiffness skateboard truck of claim 7, wherein the stop spacer is an integral feature of the axle.

11. The adjustable torsional stiffness skateboard truck of claim 10, wherein, the stop spacer includes at least one flat such that the axle can be gripped for clamping of the wheels.

12. The adjustable torsional stiffness skateboard truck of claim 10, wherein the means of clamping the wheels against each tong for loading the axle in tension comprises a threaded portion on the axle first end and a threaded portion on the second end and a nut installed on each threaded portion of the axle.

13. The adjustable torsional stiffness skateboard truck of claim 1, further comprising;

at least two clamp spacers, at least one clamp spacer located coaxially with the axle and on the outside of each tong and inside each wheel.

14. The adjustable torsional stiffness skateboard truck of claim 13, further comprising a support bushing located coaxial with the stop spacer and between each tong for adding resistance to the means of clamping.

15. The adjustable torsional stiffness skateboard truck of claim 14, wherein the stop spacer includes at least one flat such that the axle can be gripped for clamping the wheels.

16. The adjustable torsional stiffness skateboard truck of claim 14, wherein the means of clamping the wheels against each tong for loading the axle in tension comprises a threaded portion on the axle first end and a threaded portion on the second end and a nut installed on each threaded portion of the axle.

17. The adjustable torsional stiffness skateboard truck of claim 13, wherein the means of clamping the wheels against each tong for loading the axle in tension comprises an enlarged portion on the axle first end and a threaded portion on the second end and a nut installed on the threaded portion of the axle.

18. The adjustable torsional stiffness skateboard truck of claim 13, wherein the stop spacer is an integral feature of the axle.

19. The adjustable torsional stiffness skateboard truck of claim 13, wherein the attachment end has a first attachment side and a second attachment side defining a centerline between the first and second attachment sides and the compliant support bushing on the distal end of each tong is offset from the centerline, such that attachment to a surface on the first attachment side results in a first distance of the compliant support bushing on the distal end of each tong to the surface; and attachment on the second attachment side to the surface results in a second distance of the compliant support bushing on the distal end of each tong to the surface such that the first and second distances are not equal.

20. A method of using an adjustable torsional stiffness skateboard truck, the adjustable torsional stiffness skateboard truck comprising;

a fork shaped structural arm having two tongs, an attachment end for attachment to a skateboard, and having a compliant support bushing on the distal end of each tong, the two tongs being able to flex relative to each other such that they have a predetermined spring rate, an axle located in the compliance bushings of the structural arm and having a first end and a second end, two wheels coaxial with the axle and located against the outside of each tong such that the axle first end and second end extend outside the two wheels, a stop spacer located coaxially with the axle and between each tong, the stop spacer being of a length that prevents the tongs being deflected past a predetermined amount, and a means of clamping the wheels against each tong for loading the axle in tension;

the method comprising;

clamping the wheels against each tong for loading the axle in tension.

21. A method of using an adjustable torsional stiffness skateboard truck, the adjustable torsional stiffness skateboard truck comprising;

a fork shaped structural arm having two tongs, an attachment end for attachment to a skateboard, and having a compliant support bushing on the distal end of each tong, the two tongs being able to flex relative to each other such that they have a predetermined spring rate, an axle located in the compliance bushings of the structural arm and having a first end and a second end, two wheels coaxial with the axle and located against the outside of each tong such that the axle first end and second end extend outside the two wheels, at least two clamp spacers, at least one clamp spacer located coaxially with the axle and on the outside of each tong and inside each wheel, a stop spacer located coaxially with the axle and between each tong, the stop spacer being of a length that prevents the tongs being deflected past a predetermined amount, and a means of clamping the wheels against each tong for loading the axle in tension, the method comprising;

removing at least one clamp spacer causing a distance between the two wheels to decrease, clamping the wheels against each tong for loading the axle in tension.

* * * * *